US005710861A

United States Patent [19]

Stern

[11] Patent Number: 5,710,861

[45] Date of Patent: Jan. 20, 1998

[54] MULTIPLE HAIR SETTING ROLLER HEATING APPARATUS HAVING HEATING CHAMBER ENCLOSURE WITH TELESCOPIC PARTS

[75] Inventor: Paule Stern, San Diego, Calif.

[73] Assignee: Madison Star, LLC, San Diego, Calif.

[21] Appl. No.: 536,936

[22] Filed: Sep. 29, 1995

[51] Int. Cl.[6] ..... A61H 33/12; A45B 1/04

[52] U.S. Cl. ..... 392/405; 219/222

[58] Field of Search ..... 392/404, 405, 392/406, 444, 445, 447, 450, 458; 219/221, 222; 220/8; 215/222; 132/269, 271, 272

[56] References Cited

U.S. PATENT DOCUMENTS

| | | | |
|---|---|---|---|
| 2,880,902 | 6/1959 | Owsen | 220/8 |
| 3,128,882 | 4/1964 | Kardulas | 206/741 |
| 3,610,878 | 10/1971 | Thomas | 219/222 |
| 3,612,414 | 10/1971 | Nevison | 215/222 |
| 3,618,750 | 11/1971 | Reiner | 206/741 |
| 3,646,316 | 2/1972 | Volosin et al. | 219/222 |
| 3,858,029 | 12/1974 | Walter | 219/222 |
| 3,860,136 | 1/1975 | Romney | 215/222 |
| 3,916,919 | 11/1975 | Giordano | 132/40 |
| 4,526,184 | 7/1985 | Caruso | 132/39 |
| 4,572,221 | 2/1986 | Barradas | 132/33 R |
| 4,603,706 | 8/1986 | Caruso | 132/41 |
| 4,624,382 | 11/1986 | Tontarelli | 220/8 |
| 4,627,452 | 12/1986 | Caruso | 132/33 R |
| 4,723,686 | 2/1988 | Pennisi | 215/222 |
| 4,734,561 | 3/1988 | Miller | 392/405 |
| 4,974,613 | 12/1990 | Ho | 132/259 |
| 5,000,200 | 3/1991 | Roberts | 132/245 |
| 5,562,212 | 10/1996 | Rosler | 220/8 |

*Primary Examiner*—Teresa J. Walberg
*Assistant Examiner*—Sam Paik
*Attorney, Agent, or Firm*—Flanagan & Flanagan

[57] ABSTRACT

A multiple hair setting roller heating apparatus includes a telescopic enclosure open at its top and having a heating chamber defined therein and a heating element disposed within the heating chamber. The enclosure is movable telescopically between an extended condition in which the heating chamber has a first volume for containing a first plurality of rollers and a contracted condition in which the heating chamber has a second volume smaller than the first volume for containing a second plurality of rollers smaller than the first plurality of rollers. The telescopic enclosure is adapted to hold a quantity of water such that when the heating element is activated, the water boils producing steam and the rollers disposed within the heating chamber are heated simultaneously and generally evenly. The roller heating apparatus also includes a lid having a releasable locking arrangement for closing the open top of the enclosure, a water level viewing window structure that allows for viewing of the level of water within the enclosure, and a roller support assembly having a plurality of posts disposed within the enclosure for supporting the rollers within the heating chamber and being adjustable between raised and lowered positions to accommodate the extended and contracted conditions of the telescopic enclosure.

27 Claims, 8 Drawing Sheets

MULTIPLE HAIR SETTING ROLLER HEATING APPARATUS HAVING HEATING CHAMBER ENCLOSURE WITH TELESCOPIC PARTS

BACKGROUND OF THE INVENTION

1. Field of the Invention

The present invention generally relates to hair styling apparatus and, more particularly, is concerned with an apparatus for heating different numbers and sizes of hair setting rollers in a heating chamber enclosure with telescopic parts for changing the holding capacity of the heating chamber between expanded and contracted volume sizes.

2. Description of the Prior Art

Hair setting rollers are used to form waves and/or curls in a person's hair. Preferably, the person's hair is dry or nearly dry and the hair setting rollers are heated prior to placement in the person's hair. Often, a combination of both larger and smaller hair setting rollers are employed to achieve a hair style ranging from loose waves to tight curls. It is desirable to heat each of the hair setting rollers simultaneously and evenly. Depending on the person's hair and the hair style desired, sometimes it is preferable to be able to heat different numbers and sizes of the hair setting rollers.

Devices exist that are designed to heat a plurality of hair setting rollers simultaneously and evenly. An example of one such device is disclosed in U.S. Pat. No. 4,572,221 to Barradas. The Barradas patent discloses a carrying case having a plurality of heating posts within the case. Inside each post is a wire heating element. Hair setting rollers are placed over the posts and the wire heating elements heat the posts thereby heating the rollers to a desired temperature. While the carrying case disclosed in the Barradas patent may heat hair setting rollers satisfactorily, a significant drawback of the case is its limited versatility in holding and evenly heating different numbers and sizes of hair setting rollers.

Consequently, a need still exists for an apparatus that heats different numbers and sizes of hair setting rollers simultaneously and evenly.

SUMMARY OF THE INVENTION

The present invention provides a multiple hair setting roller heating apparatus designed to satisfy the aforementioned needs by avoiding the drawbacks of the prior art without introducing other drawbacks. The roller heating apparatus of the present invention is adapted for holding and heating different numbers and sizes of hair setting rollers in a heating chamber enclosure with telescopic parts for changing the holding capacity of the heating chamber between extended and contracted volume sizes.

Accordingly, the present invention is directed to the roller heating apparatus which comprises: (a) a telescopic enclosure open at its top and defining a heating chamber therein, the enclosure being convertable between extended and contracted conditions; (b) means for generating heat within the heating chamber; and (c) means disposed in the telescopic enclosure for supporting hair setting rollers in the heated chamber thereof when the enclosure is disposed at each of the extended and contracted conditions thereof. The telescopic enclosure is comprised of a lower housing body having a lower base for receiving and holding a quantity of water therein and an upper annular sidewall that extends upward from the lower base and defines an open upper end of the lower housing body, and an upper housing extension mounted through the open upper end of the lower housing body for undergoing telescopic movement along the upper sidewall toward and way from the lower base. Together, the lower housing body and the upper housing extension define the heating chamber and are telescopic relative to one another between the extended and contracted conditons for changing the holding capacity of the heating chamber. The heating means is disposed within the lower base of the lower housing body.

Preferably, the roller heating apparatus further includes a lid having a releasable locking arrangement for closing the open top of the upper housing extension, a water level viewing window structure recessed in the upper sidewall of the lower housing body, and a roller support assembly disposed within the enclosure for supporting a plurality of hair setting rollers within the heating chamber.

One feature of the roller heating apparatus of the present invention is the telescopic nature of the enclosure. The upper housing extension is movable between an extended condition wherein it is disposed away from the lower base of the lower housing body and a contracted condition in which it is disposed adjacent to the lower base of the lower housing body. When in the extended condition, the upper housing extension and the lower housing body provide the heating chamber with a first volume for holding hair setting rollers of a first number and/or size. When in the contracted condition, the upper housing extension and the lower housing body provide the heating chamber with a second volume smaller than the first volume for holding hair setting rollers of a second number and/or size smaller than the first number and/or size.

Another feature of the roller heating apparatus of the present invention is that the apparatus is capable of simultaneously and evenly heating a plurality of hair setting rollers with steam. The lid is removable so that a plurality of hair setting rollers may be placed within the heating chamber of the enclosure. With the lid replaced, the heating means are activated to heat the heating chamber thereby heating the rollers contained therein. For production of steam heat, a quantity of water is poured in the lower base before placing the rollers in the heating chamber. When the heating means are activated, the water boils producing steam that enters the heating chamber thereby steam heating the rollers contained therein.

A further feature of the roller heating apparatus of the present invention is the provision of a water level viewing window structure at a side of the enclosure. The window structure allows the level of water in the roller heating apparatus to be viewed when pouring water into the lower base of the lower housing body. It also allows the water level to be viewed during operation of the apparatus to determine whether additional water needs to be added to the roller heating apparatus.

An additional feature of the present invention is the roller support assembly disposed within the enclosure. The support assembly include an annular bottom platform, a first plurality of heat transmission rods supported upright on the platform, and a second plurality of heat transmission rods that are smaller in diameter than the first rods and are telescopically inserted into the first rods. The second rods are telescopically moveable between lowered and raised positions relative to the first rods. The second rods are placed at their lowered positions to accommodate placement of the telescopic enclosure at its contracted condition. Conversely, the enclosure is placed at the extended condition to accommodate placement of the second rods at their raised positions. The first rods support a first layer of larger diameter hair setting rollers within the heating chamber. When in their raised positions, the second rods support an additional layer of smaller diameter hair setting rollers within the heating chamber above the first layer of larger diameter hair setting rollers.

The present invention is also directed to a hair setting roller which comprises: (a) an elongated cylindrical body member being open at a pair of opposite ends and having an inner steam receiving chamber extending between the opposite open ends and a plurality of circumferentially spaced and longitudinal extending slots defined through the body for venting the passage of steam radially outwardly from the steam receiving chamber through the slots in the cylindrical body member; (b) a hair clip disposed longitudinally along a side portion of the cylindrical body member; (c) first means for mounting the hair clip to the cylindrical body to undergo rotational movement relative to and about the cylindrical body member; and (d) second means for mounting the hair clip at one end to the first mounting means to undergo pivotal movement between opened and closed positions relative to the cylindrical body member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
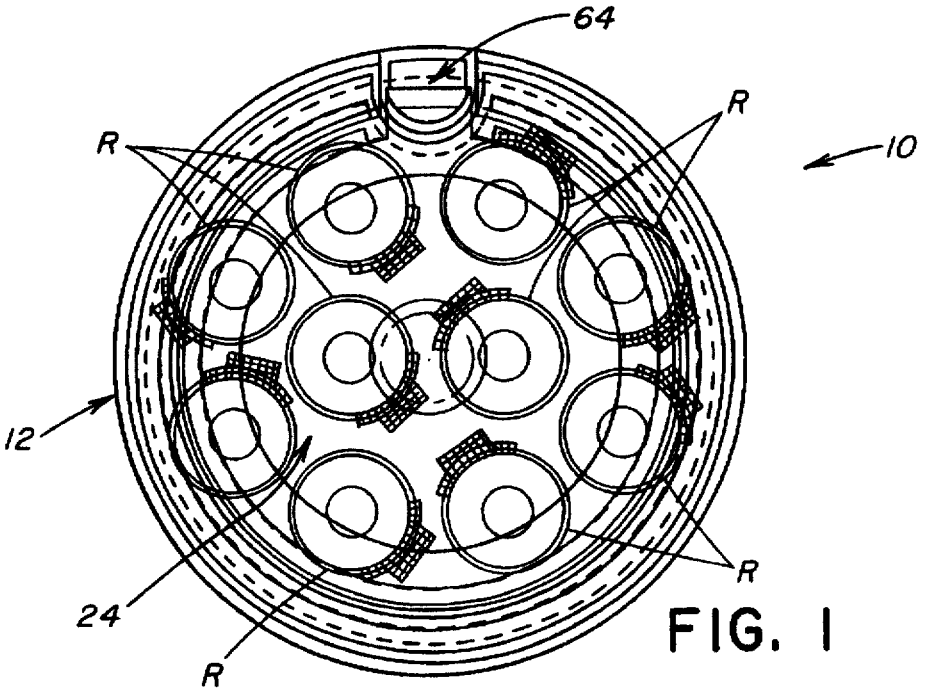
FIG. 1 is a top plan view of a multiple hair setting roller heating apparatus of the present invention.
Figure 2:
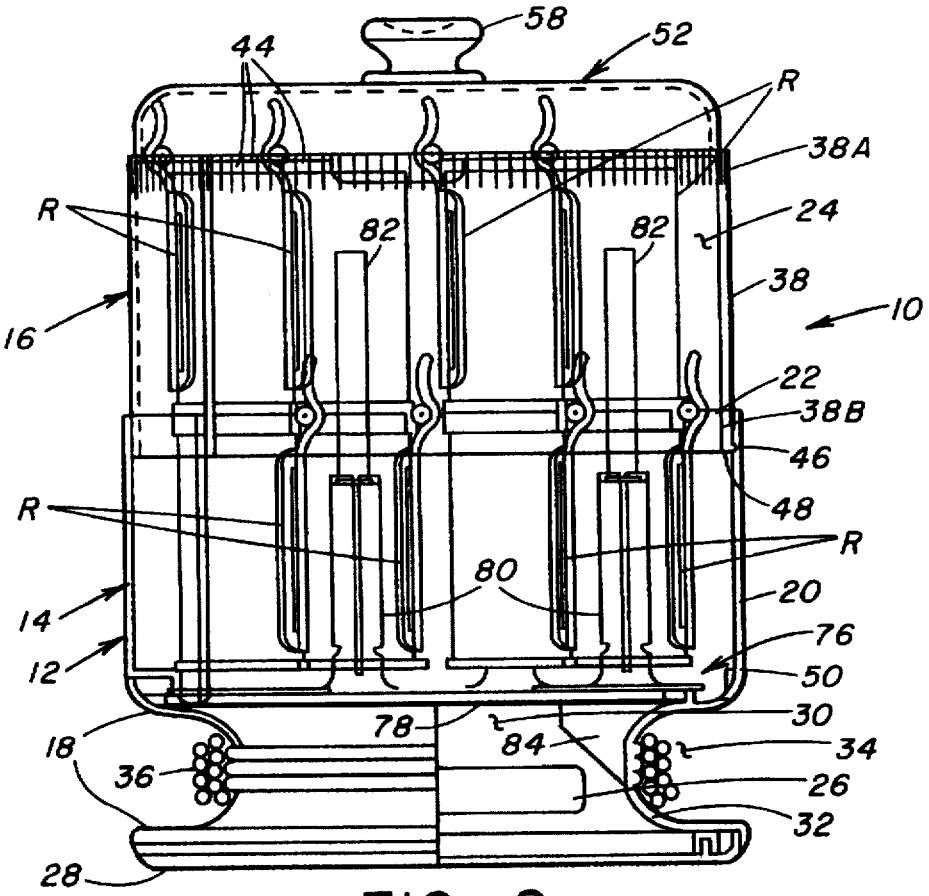
FIG. 2 is a side elevational view of the roller heating apparatus with its enclosure in an extended condition.
Figure 3:
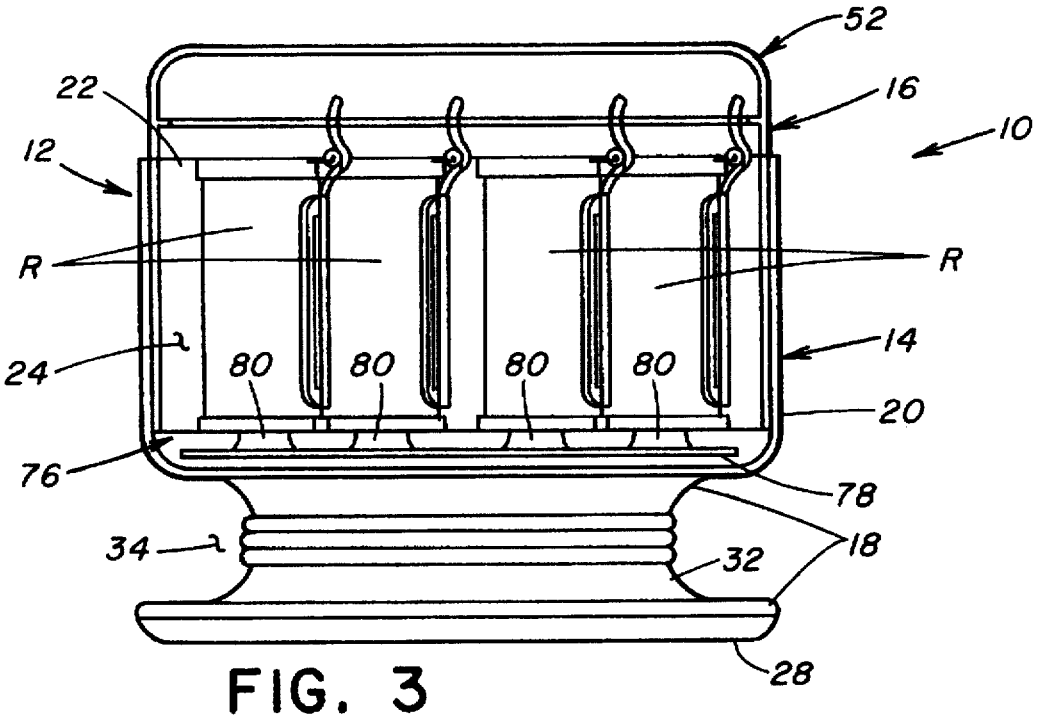
FIG. 3 is a side elevational view of the roller heating apparatus of the present invention with its enclosure in a contracted condition.
Figure 4:
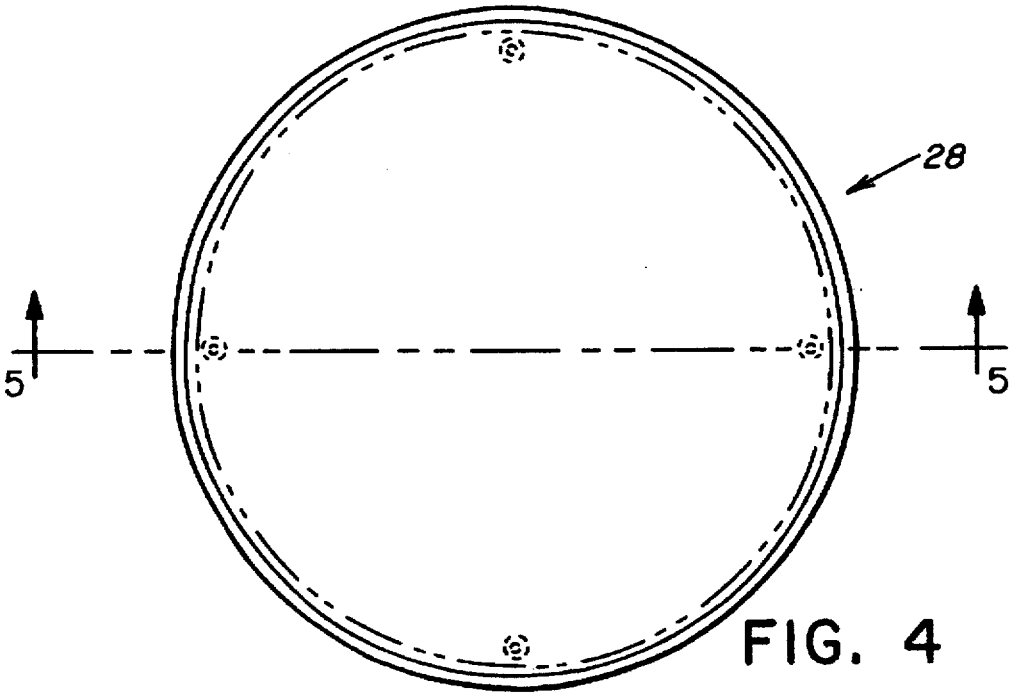
FIG. 4 is top plan view of a bottom cover of a lower base of the enclosure of the roller heating apparatus.
Figure 5:
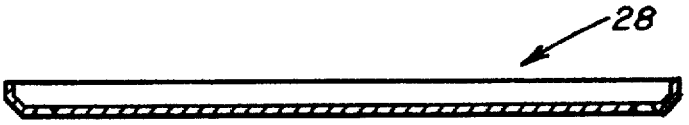
FIG. 5 is a vertical cross-sectional view of the bottom cover of the enclosure taken along line 5—5 in FIG. 4.

Referring to the drawings, and particularly to FIGS. 1 to 3, there is illustrated a multiple hair setting roller heating apparatus of the present invention, generally designated 10. The roller heating apparatus 10 is constructed for heating a plurality of hair setting rollers R for use in curling hair.

Basically, the roller heating apparatus 10 includes a telescopic enclosure 12. The telescopic enclosure 12 includes a lower housing body 14 and an upper housing extension 16. The lower housing body 14, in turn, includes a lower base 18 for receiving and holding a quantity of water therein and an upper annular sidewall 20 that is attached to and extends upward from the lower base 18. The upper annular sidewall 20 defines an open upper end 22 of the lower housing body 14. The upper housing extension 16 is mounted through the open upper end 22 and within the upper sidewall 20 of the lower housing body 14. The upper housing extension 16 is mounted within the lower housing body 14 such that it may undergo sliding telescopic movement along the upper sidewall 20 of the lower housing body 14 respectively toward and away from the lower base 18 thereof. The upper housing extension 16 is movable relative to the lower housing body 14 between an upper extended condition, as shown in FIG. 2, wherein the upper housing extension 16 is displaced away from the lower base 18 of the lower housing body 14 and a lower contracted condition, as shown in FIG. 3, wherein the upper housing extension 16 is disposed adjacent to the lower base 18 of the lower housing body 14.

Defined within the telescopic enclosure 12 by the lower housing body 14 and the upper housing extension 16 is a heating chamber 24. When the upper housing extension 16 is in the extended condition relative to the lower housing body 14, the heating chamber 24 has a first volume for containing a first plurality of the hair setting rollers R. On the other hand, when the upper housing extension 12 is in the contracted condition relative to the lower housing body 14, the heating chamber 24 then has a second volume that is smaller than the first volume for containing a second plurality of the hair setting rollers R which are smaller in number than the first plurality of hair setting rollers R. Disposed within the lower base 18 of the lower housing body 14 are means, such as a heating element 26, for generating heat in the heating chamber 24 of the telescopic enclosure 12. The heating element 26 per se can be a conventional electric unit well-known to those of ordinary skill in the art.

Referring now to FIGS. 2 through 7, the lower housing body 14 of the telescopic enclosure 12 includes the integrally connected lower base 18 and upper sidewall 20 and a bottom cover 28 underlying and connected to the lower base 18. These parts of the lower housing body 14 together define a receptacle 30 for receiving and holding a quantity of water therein. The lower base 18 preferably includes a lower annular sidewall 32 that is attached at an upper end to a lower end of the upper annular sidewall 20 of the lower housing body 14. The lower annular sidewall 32 has a diameter less than the diameter of the upper annular sidewall 20 so as to define an annular recessed region 34 surrounding the lower annular sidewall 32 and underlying the upper annular sidewall 20. An electrical cord 36 may be stored in the annular recessed region 34 in a wrapped relation about the lower annular sidewall 32. The electrical cord 36 extends through the lower base 18 to connect with the electric heating element 26 disposed in the lower base 18. As mentioned earlier, the lower base 18 also preferably includes a removable bottom cover 28. The bottom cover 28 is removably attached to a bottom edge portion of the lower annular sidewall 32 of the lower base 18 thereby affording access to the heating element 26 disposed within the interior of the lower base 18.

Referring now to FIGS. 2, 3 and 8 through 14, the upper housing extension 16 of the telescopic enclosure 12 is preferably an annular sleeve 38 of cylindrical shape concentric with the cylindrical shape of the upper sidewall 20 of the lower housing body 14. The annular sleeve 38 is slightly smaller in diameter than the upper sidewall 20 of the lower housing body 14. The sleeve 38 has axially spaced opposite top and bottom ends 38A, 38B which are open such that the top end 38A of the sleeve 38 defines an open top of the heating chamber 24 of the telescopic enclosure 12 for placing the rollers R into the heating chamber 24 and removing the rollers R from the heating chamber 24.

Figure 8:
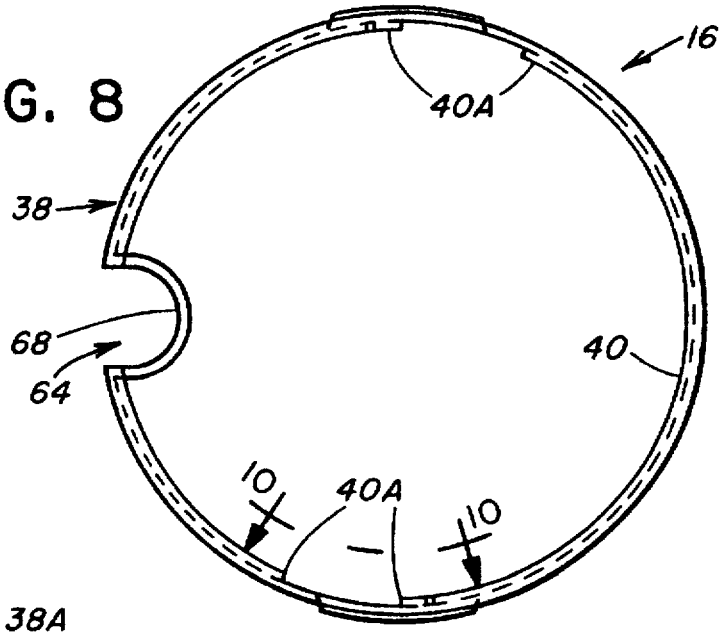
FIG. 8 is a top plan view of an upper housing extension of the enclosure of the roller heating apparatus.
Figure 10:
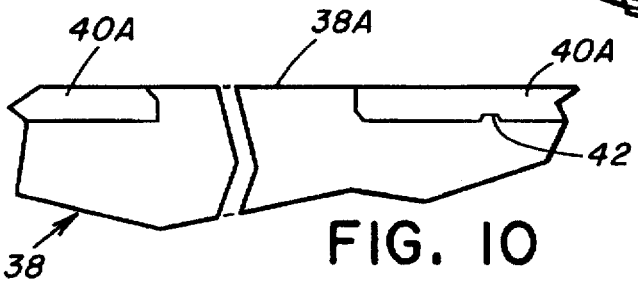
FIG. 10 is an enlarged fragmentary detailed view of an upper end of the upper housing extension of the enclosure taken along line 10—10 in FIG. 8.
Figure 12:
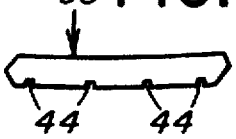
FIG. 12 is a top plan view of the upper end of the upper housing extension taken along line 12—12 in FIG. 11.
Figure 11:
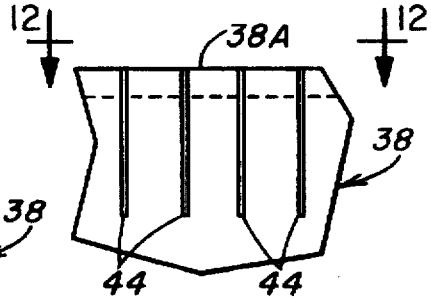
FIG. 11 is an enlarged fragmentarly side elevational view of an upper end of the upper housing extension taken at circle 11 in FIG. 9.

Referring to FIGS. 8 and 10, the sleeve 38 has a pair of arcuate shoulders 40 formed on and projecting radially inwardly from the interior surface of the top end 38A of the sleeve 38. The shoulders 40 terminate at opposite ends 40A which are angularly spaced from one another on the opposite sides of the sleeve 38. A small depression 42 is formed on the underside of each shoulder end 40A. A plurality of vertical grooves 44 are formed in the exterior surface of the sleeve 38. The vertical grooves 44 extend a short distance downward parallel to the longitudinal axis of the sleeve 38 from the top end 38A of the sleeve 38 and assist the user in gripping of the top end 38A of the sleeve 38 when sliding the upper housing extension 16 from its contracted to extended condition.

Figure 7:
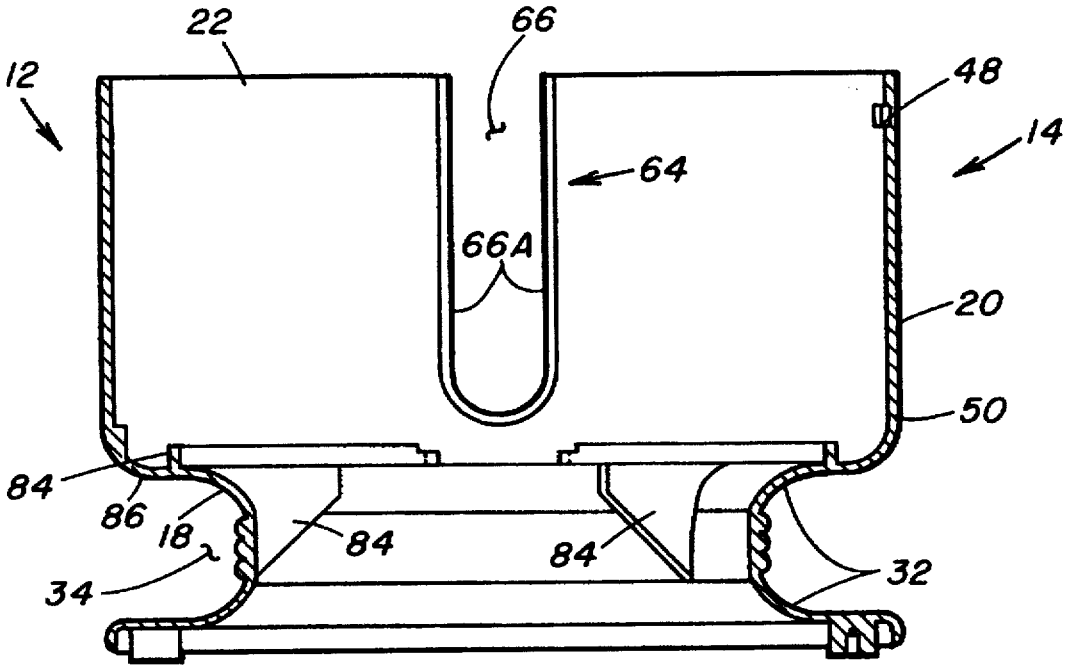
FIG. 7 is a vertical cross-sectional view of the lower housing body of the enclosure taken along line 7—7 in FIG. 6.
Figure 14:
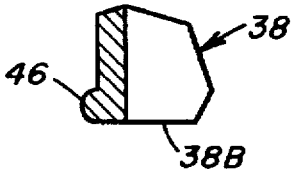
FIG. 14 is an enlarged fragmentary vertical cross-sectional view of a bottom end of the upper housing extension taken along line 14–14 in FIG. 9.

Referring to FIGS. 2 and 14, the upper housing extension 16 also includes a first protruding detent element 46 formed on the exterior of and adjacent to the bottom end 38B of the cylindrical sleeve 38. Referring also to FIGS. 2 and 7, the lower housing body 14 also includes upper and lower second recessed detent elements 48, 50 formed on the interior of and adjacent to the respective upper and lower ends of the upper sidewall 20 of the lower housing body 14. The first protruding detent element 46 is shaped complementary to and thus is matable with the upper second recessed detent element 48 when the upper housing extension 16 is in its extended condition. When the upper housing extension 16 is then moved to its contracted condition, the first protruding detent element 46 is mateable with the lower second recessed detent element 50. The mating of the first protruding detent element 46 at separate instances with the respective upper and lower second recessed detent elements 48, 50 correspondingly releasably retains the upper housing extension 16 in the respective extended and contracted conditions of the telescopic enclosure 12.

Figure 17:
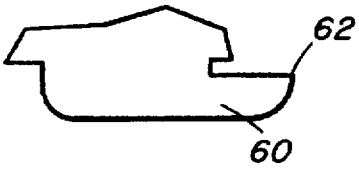
FIG. 17 is an enlarged fragmentary side elevational view of a hook element of the lid taken at ellipse 17 in FIG. 15.
Figure 16:
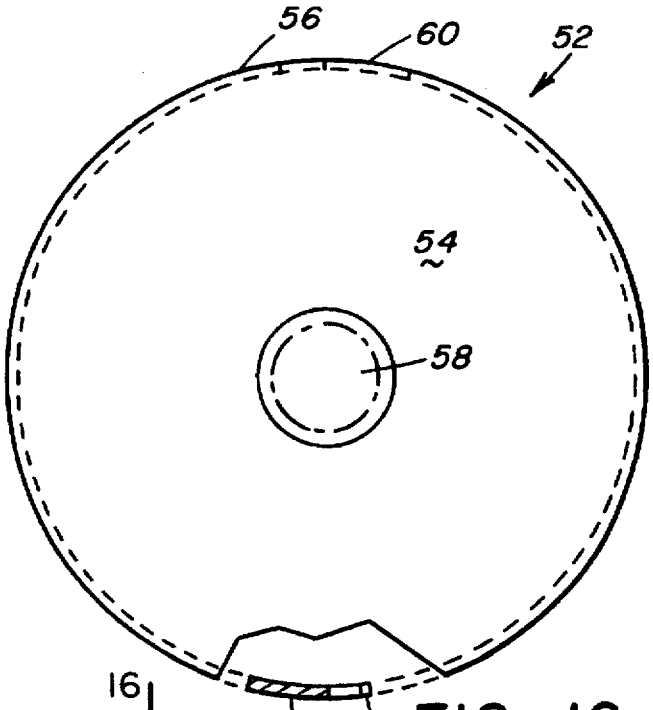
FIG. 16 is a top plan view of the lid taken along line 16—16 in FIG. 15.
Figure 15:
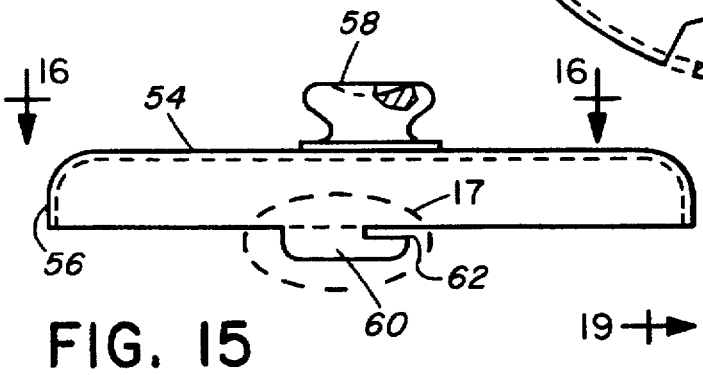
FIG. 15 is a side elevational view of a lid of the roller heating apparatus of the present invention.
Figure 18:
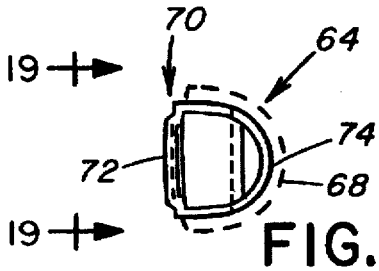
FIG. 18 is a top plan view of a water level viewing window structure of the roller heating apparatus.
Figure 19:
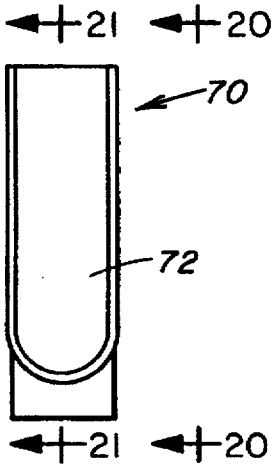
FIG. 19 is a front elevational view of the water level viewing window structure taken along line 19—19 in FIG. 18.
Figure 20:
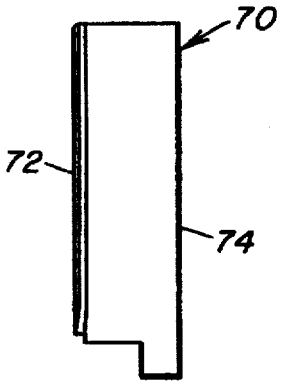
FIG. 20 is a side elevational view of the water level viewing window structure taken along line 20—20 in FIG. 19.
Figure 21:
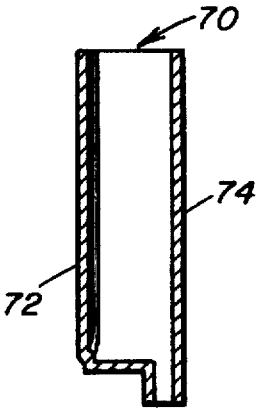
FIG. 21 is a vertical cross-sectional view of the water level viewing window structure taken along line 21—21 in FIG. 19.
Figure 25:
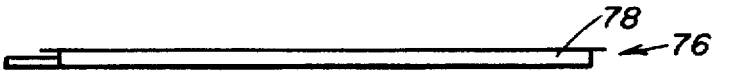
FIG. 25 is a vertical cross-sectional view of the annular bottom platform taken along line 25—25 in FIG. 24.
Figure 24:
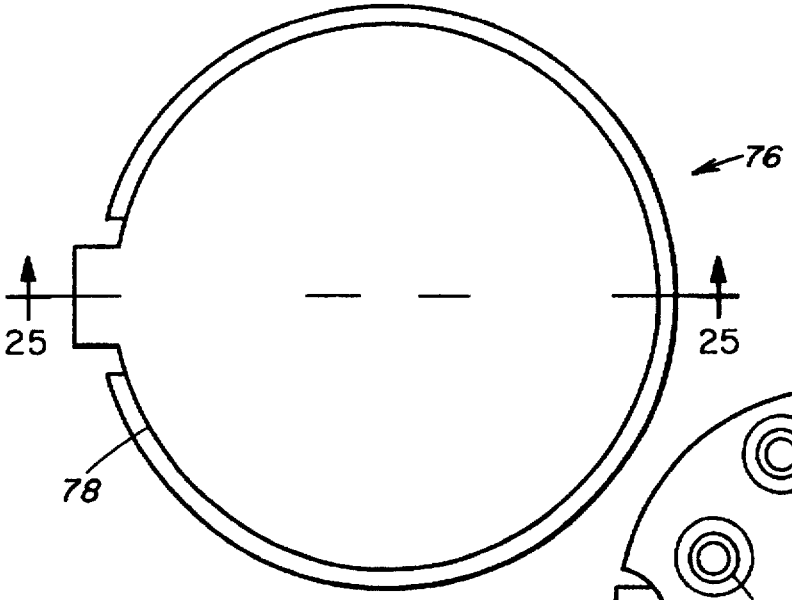
FIG. 24 is a top plan view of an annular bottom platform of the roller support assembly.
Figure 22:
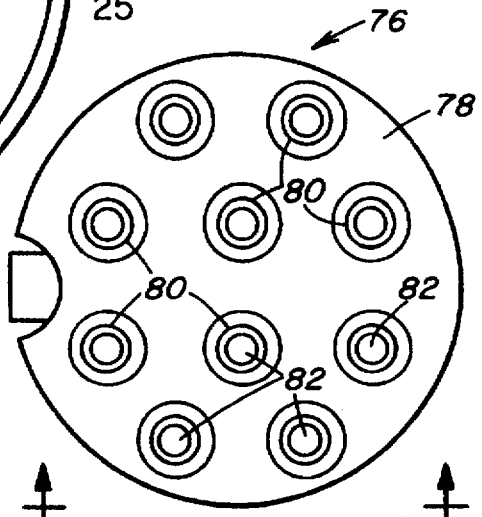
FIG. 22 is a top plan view, on a reduced scale, of a roller support assembly of the roller heating apparatus.
Figure 26:
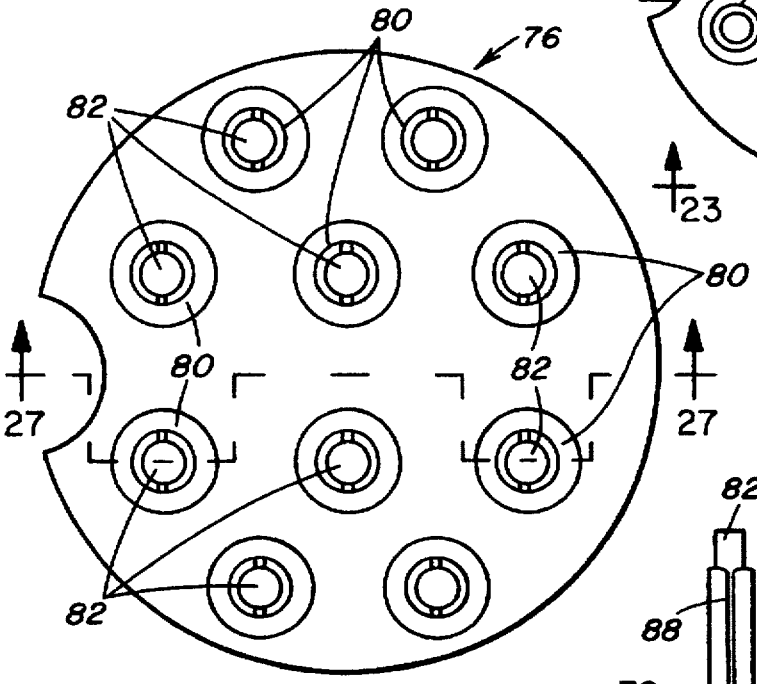
FIG. 26 is a top view of a plurality of heat transmission rods of the roller support assembly.

Referring again to FIGS. 1 through 3, the roller heating apparatus 10 also includes a top cover or lid 52. The lid 52 removably fits on the open top of the upper housing extension 16 of the telescopic enclosure 12 to enclose the rollers R within the heating chamber 24 thereof. Referring now to FIGS. 15 through 17, the lid 52 has a generally flat top panel 54, a peripheral flange 56 attached to and surrounding the top panel 54 and extending downwardly therefrom, and a central knob 58 attached to the exterior top surface of the top panel 54. A pair of hook elements 60 are attached at and extend downwardly from opposite portions of the lower peripheral edge of the flange 56. The hook elements 60 are insertable through the spaces between the ends 40A of the shoulders 40 when the lid 52 is placed on the top end 38A of the annular sleeve 38 of the enclosure 12. Preferably, each hook element 60 includes a dimple 62 which interfits with the respective depression 42 in the shoulder 40 which it underlies to retain the lid 52 in a locked position on the sleeve 38. The lid 52 is rotatable between an unlocked position in which the hook elements 60 are angularly displaced from although are below the shoulders 40 and a locked position in which the hook elements 60 underlie the shoulders 40 thereby securing the lid 52 on the upper housing extension 16. Thus, the pairs of hook elements 60 and shoulder ends 40A combine with the shoulders 40 on the top end 38A of the sleeve 38 to form a releasable locking arrangement that detachably attaches the lid 52 on the open top of the upper housing extension 16.

Figure 6:
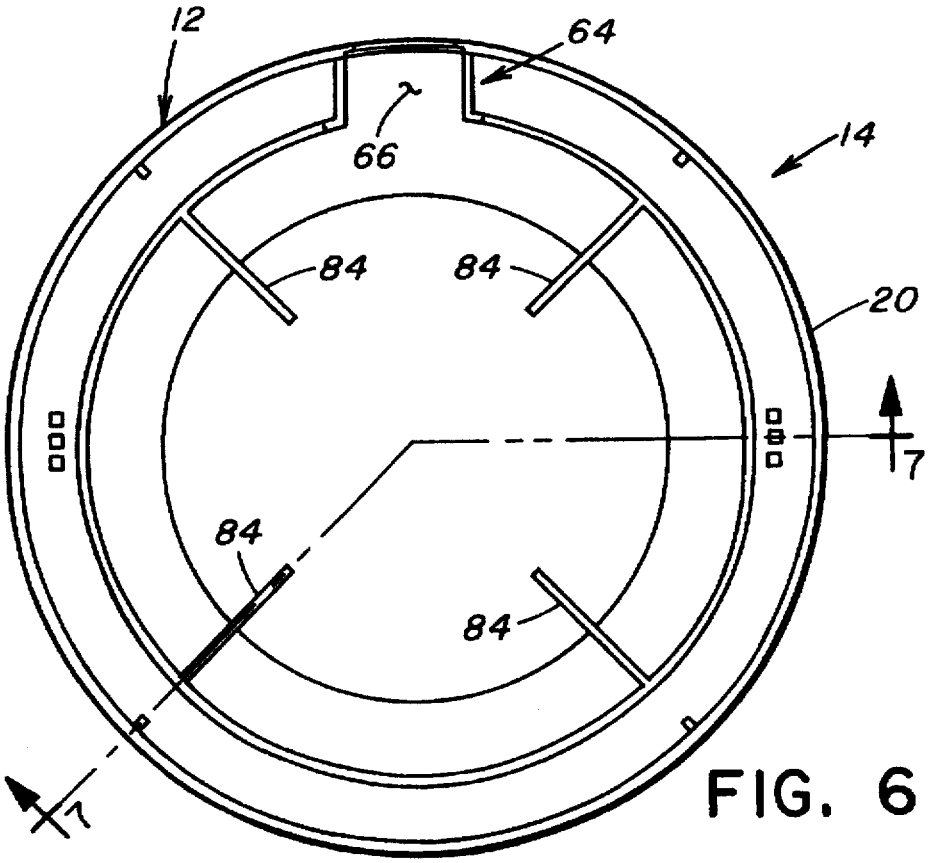
FIG. 6 is a top plan view of a lower housing body of the enclosure of the roller heating apparatus.
Figure 9:
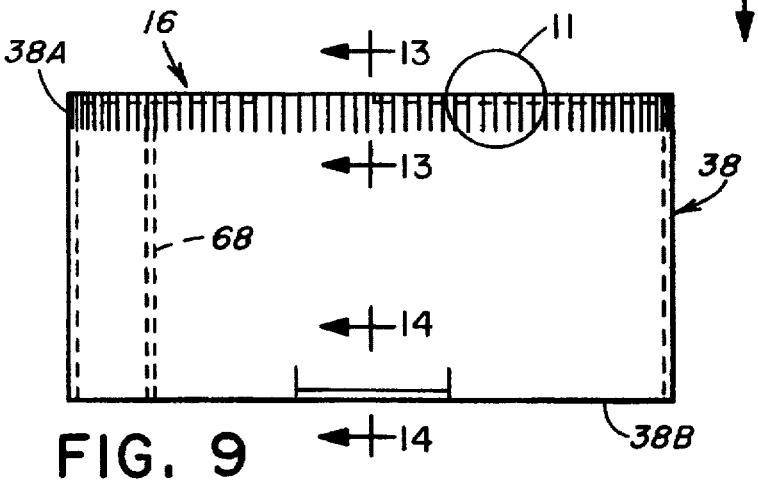
FIG. 9 is a side elevational view of the upper housing extension of the enclosure.
Figure 13:
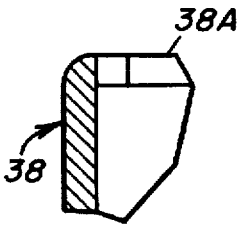
FIG. 13 is an enlarged fragmentary vertical cross-sectional view of the upper end of the upper housing extension taken along line 13—13 in FIG. 9.

Referring to FIGS. 1, 3, 7 to 9 and 18 to 21, the apparatus 10 also preferably includes a water level viewing window structure 64. The water level viewing window structure 64 is recessed in a longitudinal portion of the upper sidewall 20 of the lower housing body 14. The water level viewing window structure 64 includes a longitudinal slot 66 defined in a side portion of the upper sidewall 20 of the lower housing body 14 as best shown in FIGS. 6 and 7, a recessed wall portion 68 defined along a side of the upper housing extension 16 as best shown in FIGS. 8 and 9, and a tubular member 70 as best shown in FIGS. 18 through 21 that is mountable through the longitudinal slot 66 in the lower housing body 14 so that it extends into the heating chamber 24 of the enclosure 12.

Referring now to FIGS. 18 through 21, the tubular member 70 of the window structure 64 is open at its opposite top and bottom ends and includes an outer wall portion 72 of generally flat configuration adapted to slidably fit into and extend between opposite vertical edges 66A of the longitudinal slot 66, and an inner wall portion 74 of generally semi-cylindrical arcuate configuration connected along a pair of opposite longitudinal edges of the outer wall portion 72 and projecting into the heating chamber 24. The recessed wall portion 68 in the upper housing extension 16 has a generally arcuate configuration substantially conforming to that of the inner wall portion 74 of the tubular member 70 such that the recessed wall portion 68 of the upper housing extension 16 is concentric with and slidably telescopically moves along the inner wall portion 74 of the tubular member 70 as the upper housing extension 16 is so moved relative to the lower housing body 14 between the extended and contracted conditions of the telescopic enclosure 12. The concentric shape and telescopic movement of the recessed wall portion 68 of the upper housing extension 16 with the inner wall portion 74 of the tubular member 70 mounted to the lower housing body 14 also functions to guide and limit the upper housing extension 16 to such telescopic movement and prevent concurrent rotation of the upper housing extension 16 of the telescopic enclosure 12 relative to the lower housing body 14 thereof.

Referring now to FIGS. 22 through 31, the roller heating apparatus 10 also basically includes a roller support assembly 76 that support the rollers R within the heating chamber 24 of the telescopic enclosure 12. The roller support assembly 76 includes an annular bottom platform 78 that is disposed in the enclosure 12 between the lower base 18 and the upper sidewall 20 of the lower housing body 14, a first plurality of heat transmission rods 80 connected on and extending upright from the bottom platform 78, and a second plurality of heat transmission rods 82 insertable into and telescopically movable relative to the first rods 80. As shown in FIG. 7, the lower housing body 14 has a plurality of angularly spaced apart projections 84 formed therein on an annular flange portion 86 defined on the upper end of the lower sidewall 30 of the lower base 18 of the lower housing body 14 where it merges with the lower end of the upper sidewall 20 of the lower housing body 14. The spaced projections 84 underlie and support the roller support assembly 76 at the bottom platform 78 thereof across an open upper end of the lower base 18 and thus above the water contained within the lower base 18.

Figure 23:
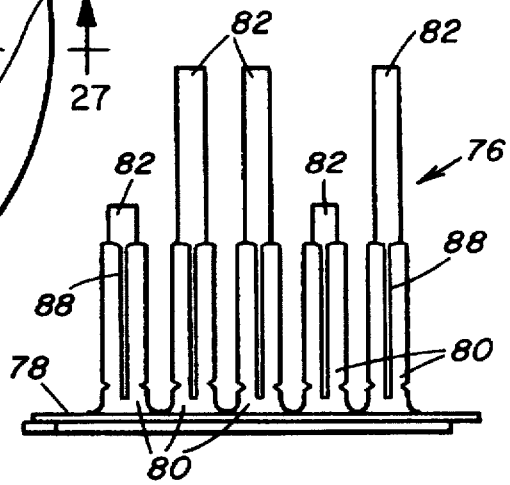
FIG. 23 is a side elevational view of the roller support assembly taken along line 23—23 in FIG. 22.
Figure 29:
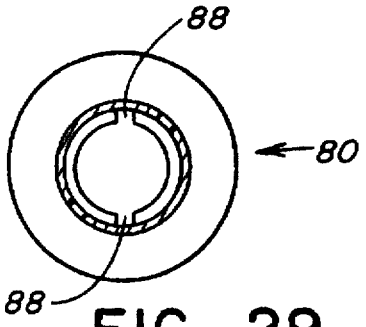
FIG. 29 is a horizontal cross-sectional view of the one first heat transmission rod taken along line 29—29 in FIG. 28.
Figure 31:
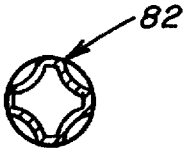
FIG. 31 is a horizontal cross-sectional view of the one second heat transmission rod taken along line 31—31 in FIG. 30.
Figure 28:
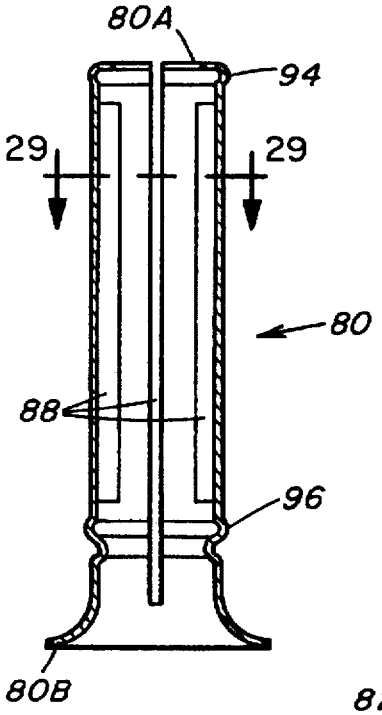
FIG. 28 is a vertical cross-sectional view of one of the first heat transmission rods of the roller support assembly.
Figure 30:
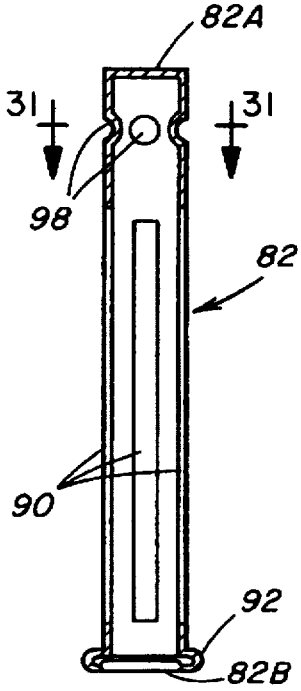
FIG. 30 is a vertical cross-sectional view of one of the second heat transmission rods of the roller support assembly.
Figure 27:
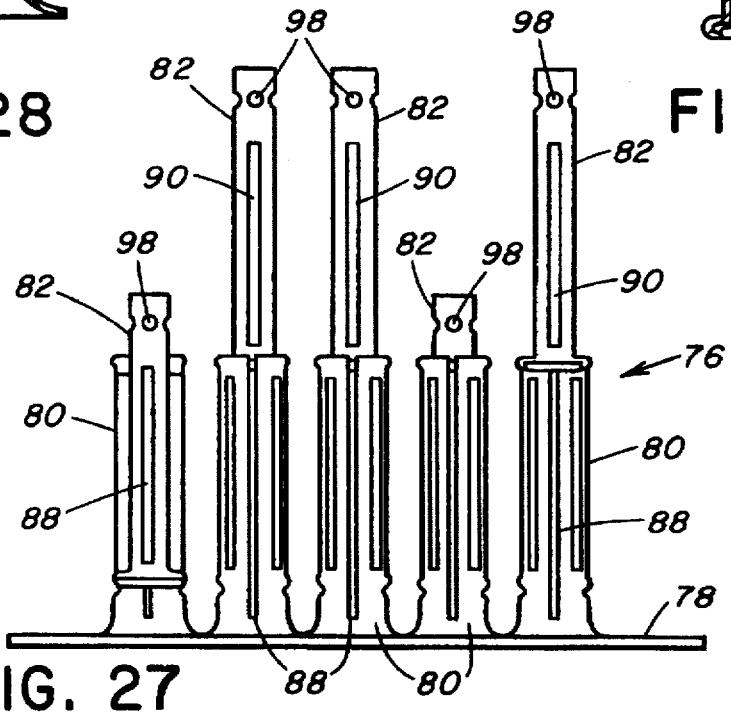
FIG. 27 is side cross-sectional view of the annular bottom platform and pluralities of first and second heat transmission rods of the roller support assembly taken along line 27—27 in FIG. 26.

The first and second rods 80, 82 are elongated hollow tubes. The first rods 80 have open upper and lower ends 80A, 80B, whereas the second rods 82 have a closed upper end 82B and an open bottom end. Both first and second rods 80, 82 also have respective longitudinal slots 88 and 90 defined therein extending between the opposite ends 80A, 80B and 82A, 82B. The second rods 82 are smaller in diameter than the first rods 80. The second rods 82 are telescopically inserted into the first rods 80 through the upper open ends 80A thereof and are mounted therein to undergo telescopic sliding movement between lowered and raised positions relative to the first rods 80, as best seen in FIGS. 23 and 27. The lower end 82B of each of the second rods 80 is deformably curled into an annular rim 92 which is matable with respective upper and lower annular recesses 94, 96 formed outwardly from the interiors of the first rods 80 at the opposite upper and lower ends 80A, 80B thereof when the second rod 82 is respectively disposed at the raised and lowered positions relative to the first rod 80. Indentations 98 formed in the sides of the second rods 82 near their top ends 82A assist the user in grasping of the second rods 82 when telescoping the second rods 82 upwardly from their lowered to raised positions. In order to dispose the upper housing extension 16 at the contracted condition relative to the lower housing body 14, the second rods 82 must first be retracted into the first rods 80 and thereby disposed at their lowered positions relative to the first rods 80. On the other hand, the upper housing extension 16 must first be disposed at the extended condition relative to the lower housing body 14 in order to extend the second rods 82 from the first rods 80 and thereby dispose the second rods 82 at their raised position relative to the first rods 80.

The above-described roller heating apparatus 10 of the present invention is utilized in the following manner to heat the hair setting rollers R. A first group Of the hair setting rollers R are disposed over the first rods 80. If necessary, the upper housing extension 16 may be raised to the extended position and the second rods 82 moved to their raised positions relative to the first rods 80 so that a second group of the hair setting rollers R can be disposed over the second rods 82. A quantity of water is poured into the receptacle 30 formed by the lower housing body 14 before placing the hair setting rollers R over the rods 80, 82. The water level viewing window structure 64 allows the level of water to be viewed when pouring water into the receptacle 30 and during operation of the apparatus 10 to determine if the addition of more water is necessary. The heating element 26 is then activated to heat the heating chamber 24 and boil the water contained in the receptacle 30, thereby producing steam in the heating chamber 24. The steam rises from the receptacle 30 of the lower housing body 14 into the interior of the heat transmission rods 80, 82. The longitudinal slots 88 and opposite open upper and ends 80A, 80B of the first rods 80 and open lower ends of the second rods 82B permit passage of the steam therethrough to the hair setting rollers R disposed over the first and second rods 80, 82 thereby heating the rollers R.

Figure 32:
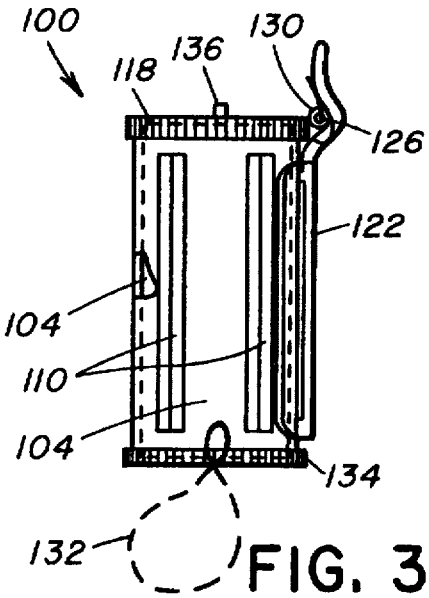
FIG. 32 is a side elevational view of a large diameter hair setting roller designed for use with the roller heating apparatus of the present invention, the roller being-shown with its hair clip closed.
Figure 33:
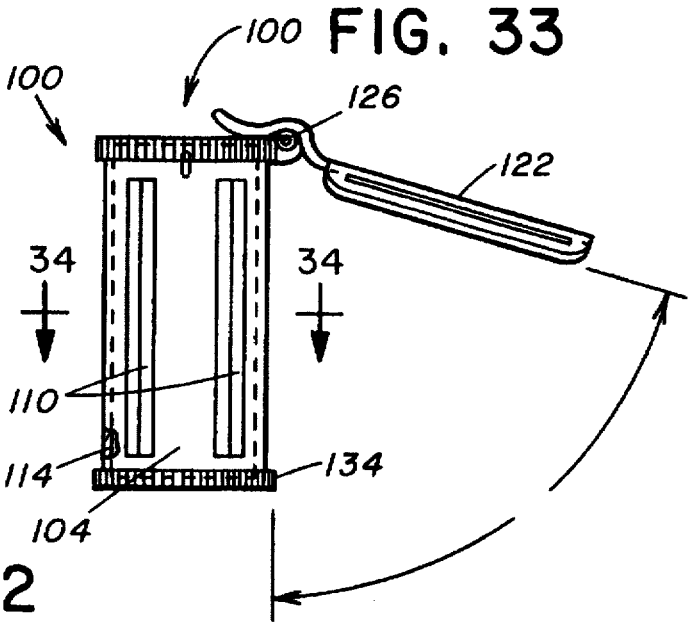
FIG. 33 is another side elevational view of the large diameter hair setting roller shown with its hair clip open.
Figure 35:
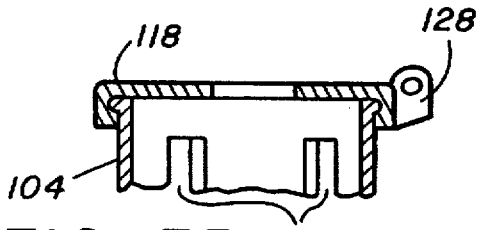
FIG. 35 is an enlarged fragmentary axial sectional view of the large diameter hair setting roller.
Figure 36:
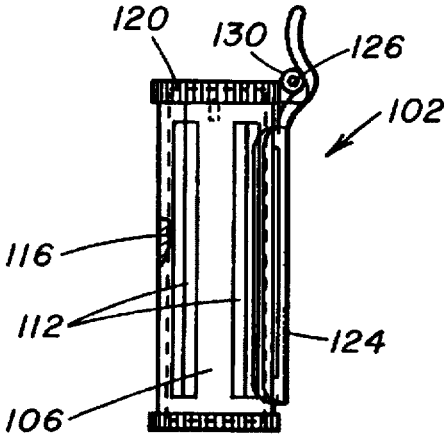
FIG. 36 is a side elevational view of a small diameter hair setting roller designed for use with the apparatus of the present invention, the roller being shown with its hair clip closed.
Figure 34:
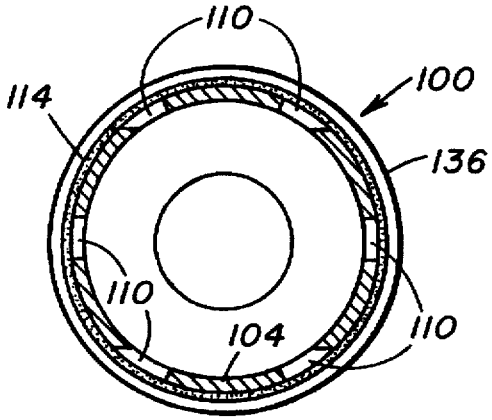
FIG. 34 is an enlarged transverse cross-sectional view of the large diameter hair setting roller taken along line 34—34 in FIG. 33.

The roller heating apparatus 10 of the present invention is particularly well suited for heating rollers R configured as shown in FIGS. 32 through 36. The larger diameter hair setting roller 100 illustrated in FIGS. 32 to 34 is adapted for fitting over the larger diameter first rods 80. Likewise, the smaller diameter hair setting roller 102 illustrated in FIGS. 35 and 36 is adapted for fitting over the smaller diameter second rods 82 when they are at their raised positions relative to the first rods 80.

More particularly, both the larger and smaller rollers 100, 102 include respective cylindrical body members 104, 106 that define an inner steam chamber 108 and have a plurality of longitudinal slots 110, 112 defined therethrough. The respective rods 80, 82 fit into the respective inner steam chambers 108 of the rollers 100, 102. The longitudinal slots 110, 112 in the respective cylindrical body members 104, 106 function as steam vents that permit passage of steam from the rods 80, 82 radially outward through the cylindrical body members 104, 106 to a porous outer covering 114, 116 of the respective rollers 100, 102 surrounding the body members 104, 106 thereof. Each of the respective rollers 100, 102 also includes an annular rim 118, 120 rotatably mounted on one of the opposite ends of the cylindrical body member 104, 106 and an elongated clip 122, 124 pivotally attached at one end by a pin 126 extending between a pair of tabs 128 fixed to and extending outwardly from the rotatable annular rims 118, 120. A coiled spring 130 encircles the pin 126 and biases the clip 122, 124 to pivotally move from an opened position, as seen in FIG. 33, to a closed position, as seen in FIGS. 32 and 35, relative to the cylindrical body member 104, 106 of the respective roller 100, 102. The rotation of the annular rim 118, 120 of the respective roller 100, 102 relative to the body member 104, 106 thereof permits the clip 122, 124 to be positioned at any desired location about the body member 104, 106 after user's hair has been wrapped about the body member 104, 106. Finally, an elastic string or band 132 is attached to an opposite annular rim 134 fixed on the opposite end of the body member 104 and is stretchible to encompass the body member 104 and pass adjacent to at least one pin 136 fixed on and projecting outwardly from the rotatable annular rim 118 on the body member 104. The elastic band 132 provides means for anchoring the roller to the hair curled thereon.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An apparatus for heating multiple hair setting rollers, said apparatus comprising:

(a) a telescopic enclosure including (i) a lower housing body defining a receptacle for receiving and holding a quantity of water therein, said lower housing body having an open upper end, and (ii) an upper housing extension extending through and within said open upper end of said lower housing body and defining therewith a heating chamber, said upper housing extension being mounted to said lower housing body for undergoing sliding telescopic movement therealong toward and away therefrom between an upper extended condition wherein said upper housing extension substantially extends away from said lower housing body and together therewith defines said heating chamber having a first volume within said enclosure for containing a first plurality of hair setting rollers therein and a lower contracted condition wherein said upper housing extension substantially extends within said lower housing body and together therewith defines said heating chamber having a second volume within said enclosure smaller than the first volume for containing a second plurality of hair setting rollers therein less in number than the first plurality of hair setting rollers;

(b) means disposed in said lower housing body of said telescopic enclosure for generating heat in said heating chamber of said enclosure; and (c) means disposed in said telescopic enclosure for supporting the pluralities of hair setting rollers in said heated chamber of said enclosure at each of said extended and contracted conditions thereof;

(d) said lower housing body further having an upper annular sidewall, a lower hollow base and a bottom cover removably attached to a bottom edge portion of said lower hollow base, said lower hollow base having a lower annular sidewall disposed below and attached to said upper annular sidewall, said lower annular sidewall having a diameter less than the diameter of said upper annular sidewall so as to define an annular recessed region surrounding said lower annular sidewall and underlying said upper annular sidewall within which is stored an electrical cord in a wrapped relation about said lower annular sidewall, said electrical cord extending into said lower hollow base to connect with said heat generating means disposed in said lower housing body.

2. The apparatus of claim 1 wherein said upper housing extension includes an annular sleeve concentric with an upper annular sidewall of said lower housing body and slightly smaller in diameter than said upper annular sidewall of said lower housing body, said sleeve having axially spaced opposite open top and bottom ends such that said open top end of said sleeve defines an open top of said heating chamber for placing the rollers into and removing the rollers from said heating chamber of said enclosure.

3. The apparatus of claim 2 wherein said upper housing extension further includes a first detent element located adjacent to said bottom end of said annular sleeve; and said lower housing body further includes upper and lower second detent elements located adjacent to said upper and lower ends thereof and being alternatively matable with said first detent element when said upper housing extension is respectively disposed at said extended and contracted conditions thereof relative to said lower housing body.

4. The apparatus of claim 2 further comprising:

a lid for removably fitting on said open top of said upper housing extension for enclosing the rollers in said heating chamber of said enclosure.

5. The apparatus of claim 4 wherein said lid includes:

a generally flat top panel;

a peripheral flange attached to and surrounding said top panel and extending downwardly therefrom; and a central knob attached to an exterior surface of said top panel.

6. The apparatus of claim 5 further comprising:

a releasable locking arrangement on said lid and said upper housing extension for detachably attaching said lid on said open top end of said upper housing extension.

7. The apparatus of claim 6 wherein said locking arrangement includes:

a pair of hook elements attached at opposite portions of a lower peripheral edge of said lid and extending downwardly therefrom; and a pair of shoulders defined along opposite portions of said top end of said sleeve of said upper housing extension at the interior thereof, said lid being rotatable between an unlocked position in which said hook elements are angularly displaced from and below said shoulders and a locked position in which said hook elements underlie said shoulders.

8. The apparatus of claim 7 wherein said hook elements and said shoulders include respective pairs of dimple and depression formations which interfit with one another to retain said lid in said locked position on said upper housing extension.

9. An apparatus for heating multiple hair setting rollers, said apparatus comprising:

(a) a telescopic enclosure including (i) a lower housing body defining a receptacle for receiving and holding a quantity of water therein, said lower housing body having an open upper end, and (ii) an upper housing extension extending through and within said open upper end of said lower housing body and defining therewith a heating chamber, said upper housing extension being mounted to said lower housing body for undergoing sliding telescopic movement therealong toward and away therefrom between an upper extended condition wherein said upper housing extension substantially extends away from said lower housing body and together therewith defines said heating chamber having a first volume within said enclosure for containing a first plurality of hair setting rollers therein and a lower contracted condition wherein said upper housing extension substantially extends within said lower housing body and together therewith defines said heating chamber having a second volume within said enclosure smaller than the first volume for containing a second plurality of hair setting rollers therein less in number than the first plurality of hair setting rollers;

(b) means disposed in said lower housing body of said telescopic enclosure for generating heat in said heating chamber of said enclosure;

(c) means disposed in said telescopic enclosure for supporting the pluralities of hair setting rollers in said heated chamber of said enclosure at each of said extended and contracted conditions thereof; and (d) water level viewing window structure means recessed respectively in longitudinal side portions of said lower housing body and said upper housing extension, said window structure means in said upper housing extension being telescopically slidable relative to said window structure means in said lower housing body as said upper housing extension undergoes sliding telescopic movement relative to said lower housing body between said upper extended condition and lower contracted condition.

10. The apparatus of claim 8 wherein said window structure means includes:

a longitudinal slot defined in said side portion of said lower housing body;

a tubular member mounted through said longitudinal slot and extending into said heating chamber of said enclosure, said tubular member having an outer wall portion of generally flat configuration adapted to slidably fit into said longitudinal slot and an inner wall portion of generally arcuate configuration and connected along opposite longitudinal edges to said outer wall portion and projecting into said heating chamber; and a recessed wall portion defined along said side portion of said upper housing extension, said recessed wall portion having a generally arcuate configuration substantially conforming to that of said inner wall portion of said tubular member such that said recessed wall portion of said upper housing extension is concentric with and slides telescopically along said inner wall portion of said tubular member as said upper housing extension is moved relative to said lower housing body between said upper extended condition and said lower contracted condition.

11. An apparatus for heating multiple hair setting rollers, said apparatus comprising:

(a) a telescopic enclosure including (i) a lower housing body defining a receptacle for receiving and holding a quantity of water therein, said lower housing body having an open upper end, and (ii) an upper housing extension extending through and within said open upper end of said lower housing body and defining therewith a heating chamber, said upper housing extension being mounted go said lower housing body for undergoing sliding telescopic movement therealong toward and away therefrom between an upper extended condition wherein said upper housing extension substantially extends away from said lower housing body and together therewith defines said heating chamber having a first volume within said enclosure for containing a first plurality of hair setting rollers therein and a lower contracted condition wherein said upper housing extension substantially extends within said lower housing body and together therewith defines said heating chamber having a second volume within said enclosure smaller than the first volume for containing a second plurality of hair setting rollers therein less in number than the first plurality of hair setting rollers;

(b) means disposed in said lower housing body of said telescopic enclosure for generating heat in said heating chamber of said enclosure; and (c) a roller support assembly disposed in said telescopic enclosure for supporting the pluralities of hair setting rollers in said heated chamber of said enclosure at each of said extended and contracted conditions thereof, said roller support assembly including (i) a bottom platform disposed in said lower housing body of said enclosure, (ii) a first plurality of heat transmission rods connected on and extending upright from said bottom platform, said first rods being adapted to receive a first group of hair setting rollers thereover, and (iii) a second plurality of heat transmission rods mounted to said first rods to undergo telescopic sliding movement between lowered and raised positions relative to said first rods, said second rods being adapted to receive a second group of hair setting rollers thereover.

12. The apparatus of claim 1 wherein said lower housing body has a lower hollow base and a bottom cover removably attached to a bottom edge portion of said lower base.

13. The apparatus of claim 12 wherein said lower housing body also has an upper ,annular sidewall, said lower hollow base having a lower annular sidewall disposed below and attached to said upper annular sidewall, said lower annular sidewall having a diameter less than the diameter of said upper annular sidewall so as to define an annular recessed region surrounding said lower annular sidewall and underlying said upper annular sidewall within which is stored an electrical cord in a wrapped relation about said lower annular sidewall, said electrical cord extending through said lower base to connect with said heating means disposed in said lower housing body.

14. The apparatus of claim 11 wherein said lower housing body has a plurality of projections formed therein and extending into the heating chamber for supporting said roller support assembly at said bottom platform thereof across heating chamber and above the water contained therein.

15. The apparatus of claim 11 wherein said first and second rods are elongated hollow tubes, said first rods having opposite open upper and lower ends, said second rods having closed upper ends and open lower ends, said first and second rods having longitudinal slots defined therein extending between said opposite upper and lower ends, said longitudinal slots and said opposite open upper and lower ends of said first rods and open lower ends of said second rods permitting passage therethrough to the hair setting rollers of rising steam generated by heating the water in said lower housing body.

16. The apparatus of claim 11 wherein said second rods must be disposed at said lowered positions relative to said first rods in order to dispose said upper housing extension at said contracted condition relative to said lower housing body, said upper housing extension must be disposed at the extended condition relative to said lower housing body in order to dispose said second rods at said raised position relative to said first rods.

17. The apparatus of claim 15 wherein each of the lower ends of said second rods is deformably curled into an annular rim being matable with respective upper and lower annular recesses formed outwardly from interiors of said first rods at said opposite upper and lower ends thereof to receive said annular rim when said second rod is disposed at said respective raised and lower positions relative to said first rod.

18. The apparatus of claim 11 wherein said second heat transmission rods are smaller in diameter than said first heat transmission rods such that said second rods telescopically insert into said first rods through upper open ends thereof and are mounted therein to undergo said telescopic sliding movement between lowered and raised positions relative to said first rods.

19. An apparatus for heating multiple hair setting rollers, said apparatus comprising:

(a) an enclosure including (i) a lower housing body defining a receptacle for receiving and holding a quantity of water therein, said lower housing body having an open upper end, and (ii) upper means mounted to said open upper end of said lower housing body and defining a heating chamber with said lower housing body;

(b) means disposed in said receptacle of said lower housing body of said enclosure for generating heat in said heating chamber of said enclosure; and (c) means disposed in said lower housing body of said enclosure above said receptacle for supporting a plurality of hair setting rollers in said heating chamber of said enclosure;

(d) said lower housing body also having an upper annular sidewall, a lower annular sidewall disposed below and attached to said upper annular sidewall and a bottom cover attached to said lower annular sidewall, said lower annular sidewall and bottom cover defining said receptacle, said lower annular sidewall having an annular concave shape which defines a minimum diameter less than the diameter of said upper annular sidewall so as to define an annular recessed region surrounding said lower annular sidewall and underlying said upper annular sidewall within which is stored an electrical cord in a wrapped relation about said lower annular sidewall, said electrical cord extending through said lower housing body to connect with said heating means disposed therein.

20. The apparatus of claim 19 wherein said hair setting rollers supporting means includes:

a bottom platform disposed in said lower housing body of said enclosure above said receptacle; and a plurality of heat transmission rods connected on and extending upright from said bottom platform, said rods being adapted to receive hair setting rollers thereover.

21. An apparatus for heating multiple hair setting rollers, said apparatus comprising:

a telescopic enclosure including a lower housing body and an upper housing extension telescopically mounted on said lower housing body;

said lower housing body including a receptacle having an open upper end;

said upper housing extension being telescopically mounted on said open upper end of said lower housing body for movement between an upper extended condition defining a first heating chamber with said lower housing body, said first heating chamber having a first volume, and a lower retracted condition defining a second heating chamber with said lower housing body, said second heating chamber having a second volume smaller than said first volume of said first heating chamber;

a heat generating device disposed in said lower housing body;

said lower housing body further including a base platform; and a first plurality of heat transmission rods each having a first end secured to said base platform and extending upwardly from said base platform in an upright orientation within said enclosure;

said first rods being adapted to support a first plurality of hair setting rollers engaging over said rods in an upright orientation within said enclosure.

22. The apparatus of claim 21 wherein said lower housing body also includes an upper annular sidewall and a lower annular sidewall disposed below and attached to said upper annular sidewall, said lower annular sidewall having an annular concave shape which defines a minimum diameter less than the diameter of said upper annular sidewall so as to define an annular recessed region surrounding said lower annular sidewall and underlying said upper annular sidewall within which is stored an electrical cord in a wrapped relation about said lower annular sidewall, said electrical cord extending through said lower housing body to connect with said heating heat generating device disposed therein.

23. The apparatus of claim 21 wherein said lower housing body also has an upper annular sidewall, a lower annular sidewall disposed below and attached to said upper annular sidewall and a bottom cover attached to said lower annular sidewall, said lower annular sidewall and bottom cover defining said receptacle.

24. The apparatus of claim 23 wherein said first and second rods are elongated hollow tubes, said first rods having opposite open upper and lower ends, said second rods having closed upper ends and open lower ends, said first and second rods having longitudinal slots defined therein extending between said opposite upper and lower ends, said longitudinal slots and said opposite open upper and lower ends of said first rods and open lower ends of said second rods permitting passage therethrough to the hair setting rollers of rising steam generated by heating the water in said lower housing body.

25. The apparatus of claim 23 wherein said second rods must be disposed at said lowered positions relative to said first rods in order to dispose said upper housing extension at said contracted position relative to said lower housing body, said upper housing extension must be disposed at the extended condition relative to said lower housing body in order to dispose said second rods at said raised condition relative to said first rods.

26. The apparatus of claim 21 further comprising:

a second plurality of heat transmission rods being telescopically mounted on said first rods for movement between lowered and raised positions relative to said first rods, said second rods being adapted to support a second group of hair setting rollers engaging over said second rods in an upright orientation within said enclosure.

27. The apparatus of claim 26 wherein said second rods are smaller in diameter than said first rods such that said second rods telescopically insert into said first rods through upper open ends thereof.

* * * * *